US005375727A

United States Patent [19]

Lavi

[11] Patent Number: 5,375,727

[45] Date of Patent: Dec. 27, 1994

[54] CLOTHES DRYING DEVICE

[76] Inventor: Moshe Lavi, 14 Ein-Gedi Street, Givataim, Israel

[21] Appl. No.: 160,028

[22] Filed: Nov. 30, 1993

[51] Int. Cl.[5] ..... A47F 7/00

[52] U.S. Cl. ..... 211/119.01

[58] Field of Search ..... 211/119.01, 119.03, 211/119.1, 119.16

[56] References Cited

U.S. PATENT DOCUMENTS

| | | | |
|---|---|---|---|
| 930,894 | 8/1909 | Siemsen | 211/119.03 |
| 1,134,850 | 4/1915 | Hebert et al. | 211/119.1 |
| 1,312,541 | 8/1919 | Heitman | 211/119.01 |

FOREIGN PATENT DOCUMENTS

| | | | |
|---|---|---|---|
| 352907 | 9/1922 | Germany | 211/119.01 |

*Primary Examiner*—Alvin C. Chin-Shue
*Assistant Examiner*—Sarah L. Purol
*Attorney, Agent, or Firm*—Thomas R. Vigil

[57] ABSTRACT

A clothes drying construction for domestic use. The construction comprises two parallel arms fixedly attached to a wall of a building at a location below a window or terrace. A plurality of members being slidingly positioned on or in each one of said arms. A rope or wire extending between each pair of members. Said members being all interconnected by a rope in such a manner that pulling the rope to one direction would close the gap between said members while pulling to the other direction would open said gap.

3 Claims, 3 Drawing Sheets

CLOTHES DRYING DEVICE

FIELD AND BACKGROUND OF INVENTION

The present invention relates to a device for drying clothes of the type conventionally provided in domestic establishments. These known devices generally comprise a frame or two arms extending from a wall below a window to be in convenient reach of a housewife or other person inside the respective room. Usually a number of ropes or wires span the distance between two sides of the frame or between the two arms. Wet clothes are hung on the said ropes or wires and are left there for complete drying. The said arrangement has a serious disadvantage: While a person who stands at the window can easily reach the rope or wire extending nearest to the position of tile said person, the successive ropes or wires farther away from the window are only difficultly reachable while the outermost rope or wire, or even two so positioned ropes are practically out of a person's reach. These arrangements are well known, and so is the said disadvantage inherent to these devices, such that no further elucidation seems to be required.

OBJECTS OF INVENTION

It is the object of the invention to provide a device of the type mentioned before, at which the ropes or wires on which the wet washing is hung can conveniently be brought into the reach of a person who is positioned, as usual in the room, at the window in front of which the drying device is positioned. Practically, the new device permits the movement of all ropes or wires nearer to or farther away from one another, the distance between individual ropes or wires being adjustable at will.

SHORT SUMMARY OF DISCLOSURE

According to the invention, the new device comprises two arms which are fixedly attached, parallel to one another, to the wall of a building at a location below of a window, a number of members being slidingly positioned on or in each one of said arms, a rope or wire extending between each pair of member and spanning the distance between a member on one arm and a member on the opposite arm, a pull rope being provided which runs through an endless path over a number of idle rollers which path extends along both sides of each one of the said arm and also twice through the distance between the fixing points of the arms to the wall, the outermost two members being fixedly connected to the said endless rope, a further connecting rope extending along each arm and being fixedly connected to the outermost pair of members and affixed to the respective arm near its connection to the wall.

The invention will now be described in detail with reference to the annexed three Figures of drawings which show the new device in three different positions of the clothes hanging ropes.

SHORT DESCRIPTION OF DRAWINGS

FIG. 2 shows the device with some of the ropes (except the one nearest to the wall) being close to each other, while

DETAILED DESCRIPTION OF INVENTION

Figure 1:
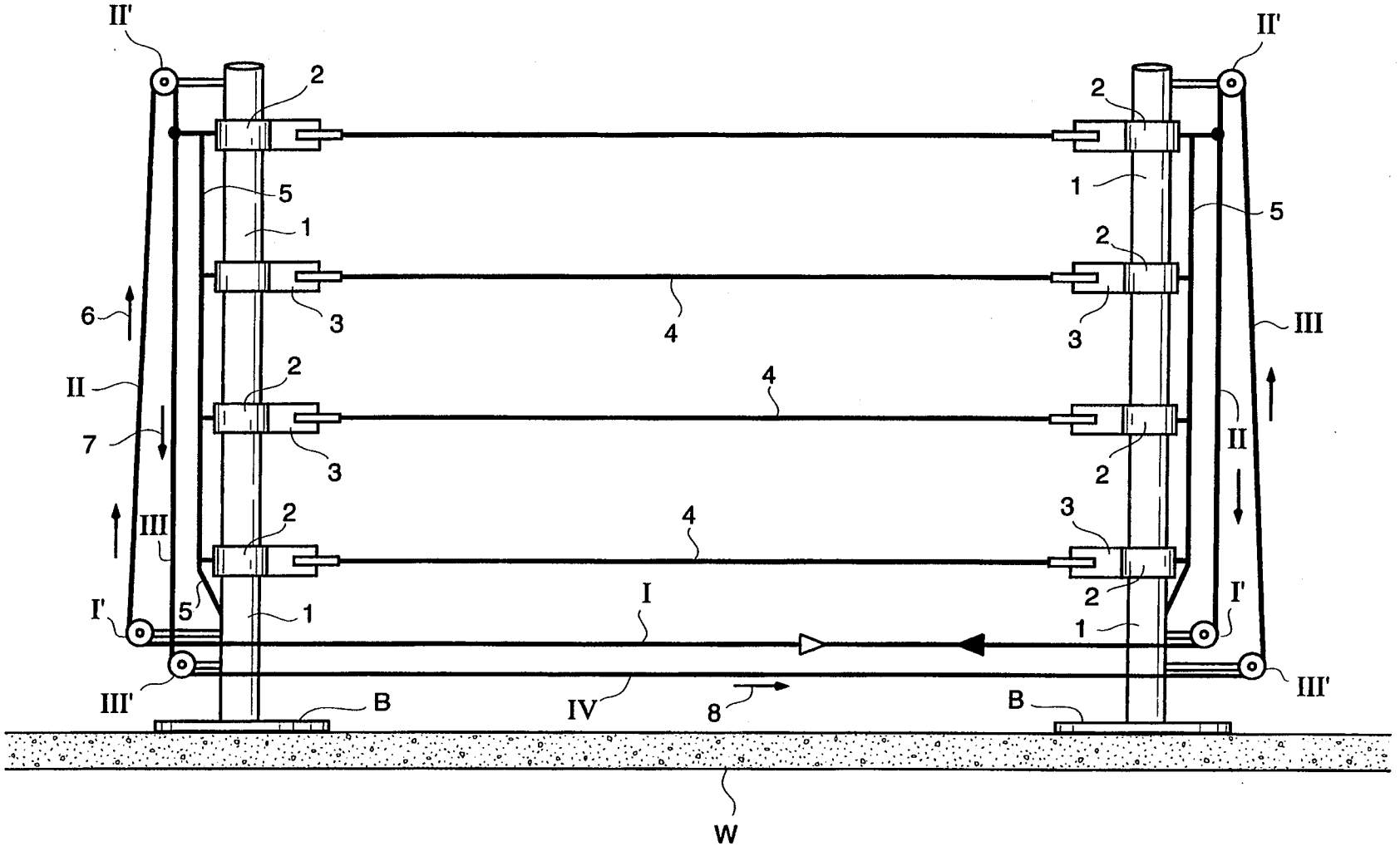
FIG. 1 is a plan view of the device, all ropes being in position of maximal distance from each other.

Turning first to FIG. 1, to the wall of a building indicated by the letter W are affixed at a distance from one another, at common level, two base plates B. From plates B extend two arms 1 on each of which is slidingly positioned a number of shackle like ring members 2. Each ring member 2 carries affixed to it, a clamp 3, each clamp holding the end of a rope (or wire) 4 in a way that each rope or wire 4 is held by two oppositely disposed clamps 3 each extending from one of the arms 1.

A pull rope which includes a number of sections extends over an endless path, being led about a number of idle guide rollers: A central rope section I crosses both arms 1 and around idlers I' continues as sections II to idlers II' which are near the outer ends of the two arms 1. From here, after idler II' rope sections III run along sections II, and round idler III' to a section IV which is parallel to section I.

Two further connection ropes 5 (entirely distinct from the endless path pull rope) are affixed each to the outermost one and all following of the two rings 2 and also fixedly connected to one of the arms 1 near its connection to plate B.

By moving the central section I of the endless rope, all its section are moved into one or the other direction, taking along the ring members 2 and the clothes line (ropes 4).

Figure 2:
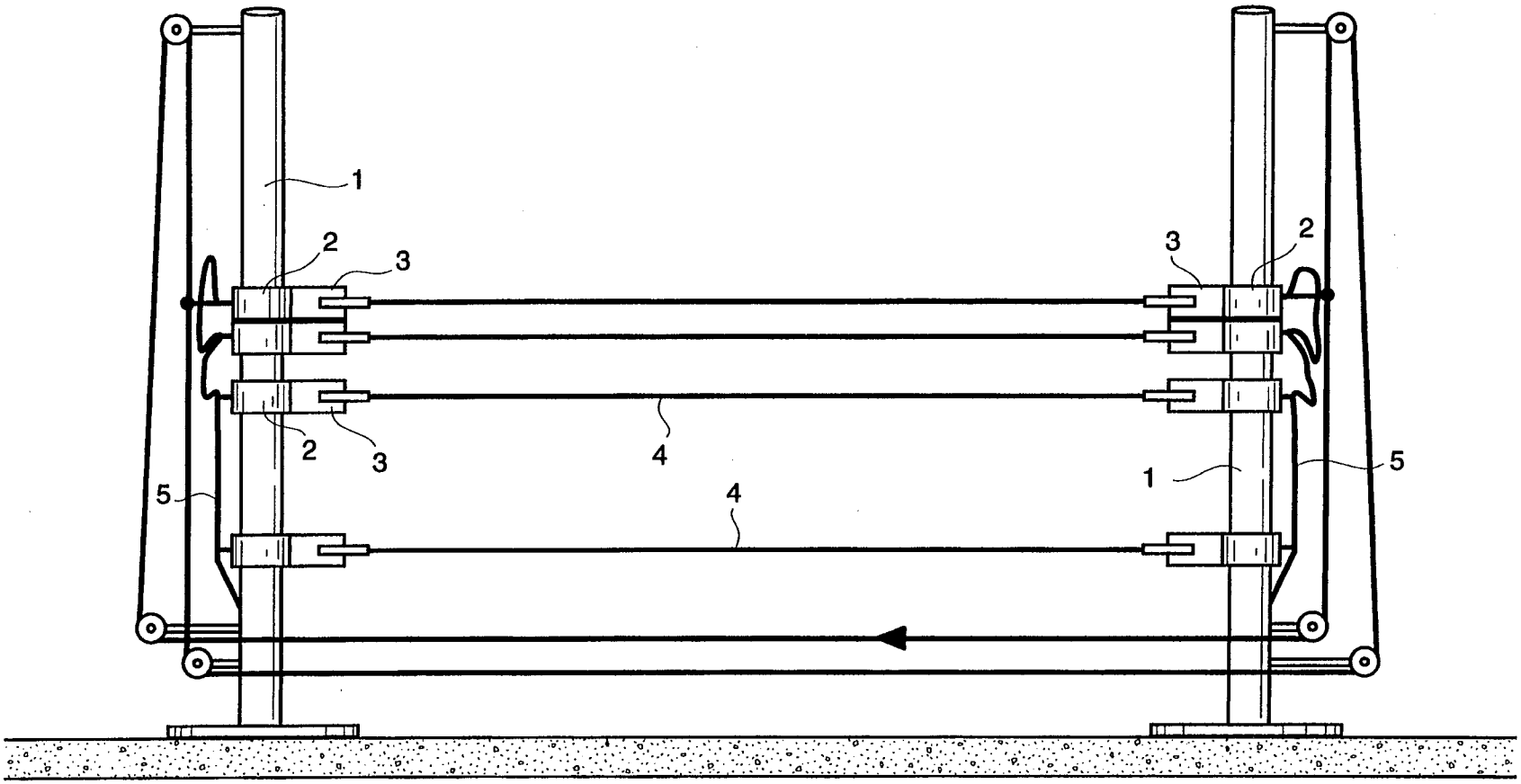
Figure 3:
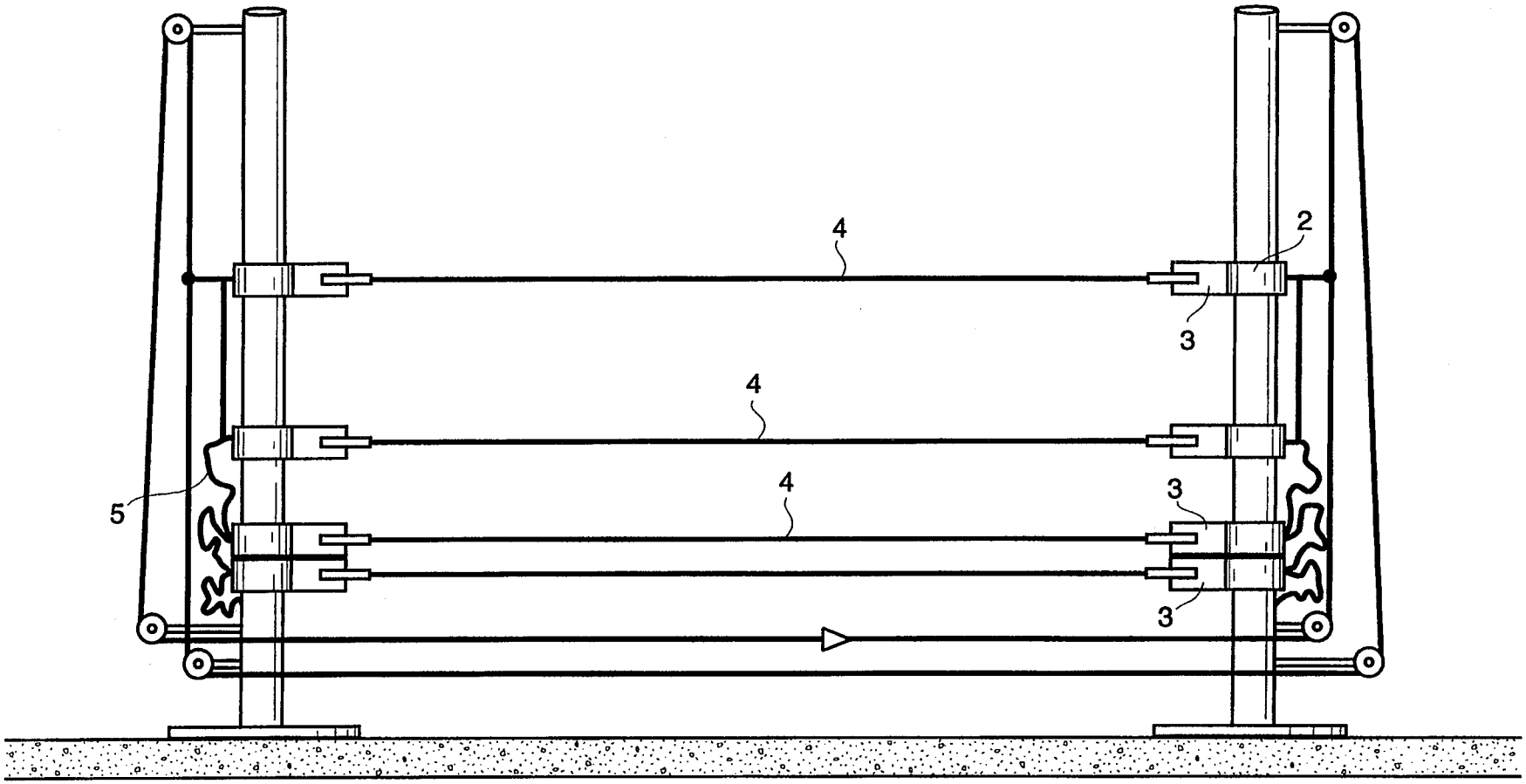
FIG. 3 shows part of the ropes shifted to intermediate positions.

The central section I bears two arrow signs: a black one and a white one. Moving section I in the direction of the black arrow results in bringing the clothes' lines nearer to one another, as follows:

Moving Section I towards the left of FIG. 1 pulls section I towards the wall W, while section II on the-left moves away from the wall (arrow 6). Section III (left) moves towards the wall (arrow 7) and causes section IV to move to the right (arrow 8), causing section III right to move around idler II' to "push" section II right back to section I. Obviously this causes the outermost rings 2 to slide towards the wall W and to push the all rings 2 in the same direction. This also leads to the separate connection ropes 5 to become slack and crumple, as shown in FIGS. 2 and 3.

Moving the central section I in the direction of the white arrow, all movements of section II–IV ere in reverse of the movements described and cause the ring members 2 to slide outwardly into "washing hanging" position. In that state the connection ropes 5 which are connected to all rings 2 pull these outwardly re-establishing the position shown in FIG. 1.

It should be noted that the two arms 1 could be of any cross section such as round or hectagonal or substantially C profile such as a rail enabling the moving member to travel therein.

I claim:

1. A device for hanging wet clothes for drying comprising two, generally parallel, spaced apart arms each of which is fixedly attached at one end thereof to the wall of a building beneath a window opening in the wall, said arms having one or more pairs of ring members mounted thereon each ring member being slidingly positioned on one of said arms, characterized by the provision of a flexible and bendable elongate member of the type including a rope or wire spanning the distance between each two ring members of a pair of ring members, a pull rope being provided which runs through an endless path over a number of idler rollers mounted to said arms, said path including a first section along each one of said arms and parallel thereto with both first sections being arranged to move in the same direction, a second section along each one of said arms and parallel thereto with both second sections being arranged to move in the reverse direction of the rope or wire movement of said first sections and moveable two times through the distance between the points at which the two arms are fixed to the wall of the building, the outermost pair of ring members slidingly positioned on said two arms being fixedly connected to the respective first sections of said pull rope and the outermost ring member of each pair of opposed ring members and all of the following ring members slidingly positioned on each of said two arms being fixedly connected to a connecting rope extending along each one of said arms.

2. The device of claim 1, characterized in that each of said connecting ropes is entirely distinct from the endless path pull rope and each of said connecting ropes is affixed at one end of the outermost one and to all of the following ring members on the respective arm and also fixedly connected at its other end to the respective arm near its connection to the building wall.

3. The device of claim 1, characterized in that said arms have a rail like cross section and each of said ring members has a centrally located opening having a cross section permitting it to be placed on one of said arms.

* * * * *

UNITED STATES PATENT AND TRADEMARK OFFICE

CERTIFICATE OF CORRECTION

PATENT NO. : 5,375,727

DATED : December 27, 1994

INVENTOR(S) : Moshe Lavi

It is certified that error appears in the above-indentified patent and that said Letters Patent is hereby corrected as shown below:

Column 1, line 18, "tile said" should be --the said--.

Column 2, line 45, "ere" should be --are--.

Signed and Sealed this

Seventh Day of March, 1995

*Attest:*

Bruce Lehman

BRUCE LEHMAN

*Attesting Officer*

*Commissioner of Patents and Trademarks*